US007595442B2

(12) United States Patent
Grover

(10) Patent No.: US 7,595,442 B2
(45) Date of Patent: Sep. 29, 2009

(54) ERGONOMIC DRUMSTICK

(76) Inventor: Thomas Elgin Grover, 7011 Vinings Way, Columbus, GA (US) 31907

( * ) Notice: Subject to any disclaimer, the term of this patent is extended or adjusted under 35 U.S.C. 154(b) by 0 days.

(21) Appl. No.: 11/862,642

(22) Filed: Sep. 27, 2007

(65) Prior Publication Data

US 2009/0084246 A1 Apr. 2, 2009

(51) Int. Cl.
*G10D 13/02* (2006.01)

(52) U.S. Cl. ..... 84/422.4

(58) Field of Classification Search ..... 84/422.4; 285/332, 332.1; 4/390
See application file for complete search history.

(56) References Cited

U.S. PATENT DOCUMENTS

| | | | | | |
|---|---|---|---|---|---|
| 1,395,793 | A | * | 11/1921 | Broschart | 401/6 |
| 1,953,619 | A | * | 4/1934 | Ludwig | 84/422.4 |
| D149,677 | S | * | 5/1948 | Roblin | D7/395 |
| 3,137,194 | A | * | 6/1964 | Simpson, Jr. | 84/422.4 |
| D250,082 | S | * | 10/1978 | Breger | D7/649 |
| D263,272 | S | * | 3/1982 | Jagger | D7/664 |
| D264,422 | S | * | 5/1982 | Jagger | D7/650 |
| D295,872 | S | * | 5/1988 | Koumarianos | D17/22 |
| D314,490 | S | * | 2/1991 | Elie | D7/395 |
| D324,744 | S | * | 3/1992 | Rommerdale | D28/62 |
| D328,759 | S | * | 8/1992 | Pozil et al. | D19/55 |
| D359,508 | S | * | 6/1995 | Debbas | D19/47 |
| D361,695 | S | * | 8/1995 | Sutker | D7/401.2 |
| D363,310 | S | * | 10/1995 | Oka | D19/55 |
| 5,477,768 | A | * | 12/1995 | Swift | 84/453 |
| 5,696,339 | A | * | 12/1997 | Brennan | 84/422.4 |
| D396,396 | S | * | 7/1998 | Larson | D8/303 |
| 6,006,952 | A | * | 12/1999 | Lucas | 222/211 |
| 6,028,261 | A | * | 2/2000 | Johnson | 84/422.4 |
| 6,069,308 | A | * | 5/2000 | Rabb | 84/422.4 |
| D432,168 | S | * | 10/2000 | Provda | D19/55 |
| 6,310,278 | B1 | * | 10/2001 | Butler | 84/422.4 |
| 6,343,885 | B1 | * | 2/2002 | Heyne | 401/48 |
| 6,423,890 | B2 | * | 7/2002 | Zbrzezny et al. | 84/422.4 |
| D466,388 | S | * | 12/2002 | Chemtob | D8/107 |
| 7,176,369 | B1 | * | 2/2007 | Brooks | 84/422.4 |
| D561,828 | S | * | 2/2008 | Wesselmann | D19/41 |
| 2006/0027073 | A1 | * | 2/2006 | Richard | 84/422.4 |
| 2009/0084246 | A1 | * | 4/2009 | Grover | 84/422.4 |

* cited by examiner

*Primary Examiner*—Jeffrey Donels
*Assistant Examiner*—Robert W Horn
(74) *Attorney, Agent, or Firm*—Thomas, Kayden, Horstemeyer & Risley, LLP

(57) ABSTRACT

An ergonomic drumstick comprising a shaft member and a grip member including a load face portion, an apex portion, and a bore. The grip member ergonomically fits the profile of a user's fingers, enabling the user to retain the drumstick in a particular position and to play comfortably for extended periods of time. The ergonomic drumstick allows a relaxed grip, reducing the shock transfer to the user's hands, which in turn reduces fatigue. The ergonomic drumstick also can be fully adjustable, and reusable, with a grip selectable for fit, profile and size.

12 Claims, 2 Drawing Sheets

ERGONOMIC DRUMSTICK

BACKGROUND

1. Technical Field

The invention relates to drumsticks.

2. Description of the Related Art

Musicians use drumsticks to play instruments such as drums, cymbals, chimes, xylophones, etc. The prior art teaches several variations on drumsticks to make the grip more comfortable, but none of the references discloses a drumstick with a removable grip having an apex portion and a load face portion designed to ergonomically fit the profile of a user's two fingers.

U.S. Pat. No. 3,137,194 to Simpson (hereinafter Simpson), discloses position rings for drumsticks to assist the drummer in holding onto the sticks, to help properly position the drummer's hand on the stick, and for providing comfort in the gripping area. The patent discloses a detachable pair of rings which may be positioned on each drumstick at positions preferred by the user. However, the O-rings in Simpson are positioned by means of holes that are formed in the drumstick. They cannot be positioned at any location on the drumstick. Also, there is no discussion as to how to make the rings ergonomically fit the user's hand.

U.S. Patent Application 2006/0027073 by Richard (hereinafter Richard) discloses a drumstick including a plurality of rings forming ridges designed to circumferentially encompass a drumstick. This is described as an ergonomic drumstick. Richard teaches that the drumstick grip may be adjustable to provide greater comfort to the drummer's hand and that it may be removable to allow it to be transferred from one drumstick to another. The types of drumstick grips shown in the Richard application are rings and spiral wraps. The rings and wraps are not ergonomically designed to mate with a drummer's fingers. Specifically, the Richard design does not describe how a ring may fit between a user's two fingers such that the fingers will engage ergonomically with the grip. Richard does not disclose a grip having a load face portion and an apex portion.

U.S. Pat. No. 5,696,339 to Brennan (hereinafter Brennan) discloses a triangular sleeve which is either slipped over the end of the drumstick or slipped over the drumstick which has been milled to receive the triangular grip. Brennan does not teach a grip which ergonomically engages two of a drummer's fingers.

U.S. Pat. No. 5,477,768 to Swift describes a rubber ball mounted on a drumstick shaft to provide a grip to be held in the palm of the hand as in a ball of a ball and socket joint. This grip is designed to be held in the palm of the hand rather than between two fingers.

U.S. Pat. No. 4,488,470 to Larrain discloses drumsticks which have serially disposed length portions of reducing diameter from the butt end to the tip end of the drumstick. Grooves are formed around and in the handle end to improve the grip of the drummer. These are manufactured into the drumstick and are not adjustable. Also, like the other inventions, these drumsticks are not designed to ergonomically engage the fingers of a user's hand.

U.S. Pat. No. 6,759,583 to Mizuno, et al. describes a drumstick including an elastic component forming a handle used for holding the stick. The elastic component appears to aid the drummer's grip and also to absorb some of the vibration of playing the instrument. However, the elastic component is not removable, and it cannot be adjusted in different positions on the stick. Additionally, the elastic component does not ergonomically engage the fingers of a user's hand.

SUMMARY

In one embodiment, disclosed is a drumstick comprising a shaft member and a grip member including a load face portion, an apex portion, and a bore.

In another embodiment, disclosed is an ergonomic grip configured to circumferentially encompass a percussion instrument, wherein the ergonomic grip comprises a load face portion, an apex portion, and a bore.

Other systems, devices, methods, features and/or advantages of this disclosure will be or may become apparent to one with skill in the art upon examination of the following drawings and detailed description. It is intended that all such additional systems, devices, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale.

DETAILED DESCRIPTION

A drumstick having a grip designed to ergonomically engage a user's fingers is provided. In this regard, several exemplary embodiments are described.

A drumstick is a percussive musical instrument designed for use in the playing of drums, cymbals, xylophones, and chimes. A user may grip drumsticks for extended periods of time while practicing or playing a musical composition. In particular, conventional drumsticks made of wood or other materials have smooth surfaces. A conventional drumstick may not fit a user's hand comfortably and may be prone to slipping during play. Ergonomics is concerned with the fit between people and the tools they use to carry out activities. Conventional drumsticks lacking an ergonomic fit can place stress on the joints in the hands and wrists, which may result in injuries such as "drummer's elbow," tendonitis, carpal tunnel syndrome, or blisters. A grip feature ergonomically fitting the profile of a user's fingers enables the user to retain a drumstick in a particular position and play comfortably for extended periods of time. An ergonomic drumstick allows a relaxed grip, reducing the shock transfer to the user's hands, which in turn reduces fatigue. The ergonomic drumstick can be fully adjustable and reusable, with a grip selectable for fit, profile and size.

Figure 1:
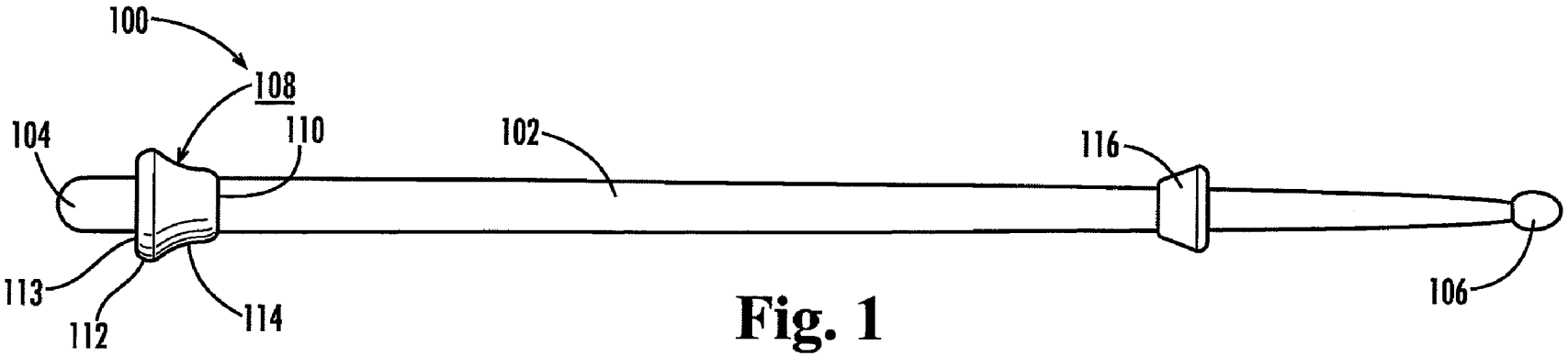
FIG. 1 illustrates an exemplary embodiment of an ergonomic drumstick.

FIG. 1 illustrates an exemplary embodiment of an ergonomic drumstick 100 featuring an unobtrusive, elegant and simple design. The ergonomic drumstick 100 comprises both a shaft member 102 and a grip member 108. In this embodiment, the shaft member 102 is cylindrical and elongated. Shaft member 102, where cylindrical, has a diameter, which is typically in the range of ¼- to ⅝-inch. The shaft member 102 may include other shapes such as elliptical or angular.

The shaft member 102 may be made of wood, plastic, metal, or other materials. The shaft member 102 may be a conventional drumstick already in production by various manufacturers. Thus, consumers can create their own ergonomic drumsticks. The ergonomic drumstick 100 includes the grip member 108 attached to the shaft member 102. The grip member 108 is made of rubber, but it also may be made of other materials such as plastic or any of a number of synthetic, elastomeric materials. The shaft member 102 may be covered with a durable heat shrink material, (not shown) thereby giving the ergonomic drumstick 100 a great feel and making the grip member 108 easy to apply and remove.

The grip member 108 has a bore 110. The grip member 108 is attached to the shaft member 102 through bore 110. Bore 110 is shaped to match shaft member 102, which may have an elliptical or angular cross-section, for example. In this embodiment, bore 110 is cylindrical and has a diameter, which may be 20 to 30% smaller than the diameter of the shaft member 102 in order to supply sufficient tension to fix grip member 108 to shaft member 102. However, because of the elastic properties of grip member 108, the bore 110 may accommodate other shaft members having varying diameters, including shaft members with dipped coatings or covered by wraps.

The grip member 108 comprises two portions: an apex portion 112 and a load face portion 114. The apex portion 112 and load face portion 114 may vary in width as desired. The apex portion 112 has a back end 113, which may be flat and substantially perpendicular to the axis of the bore 110. The load face portion 114 is curvilinear with a concave taper in this embodiment. In another embodiment, the load face portion 114 may instead be conical, with a taper having an angle relative to the shaft member 102. This taper angle may be between 30 and 60 degrees, for example.

The grip member 108 divides the shaft member 102 into two ends: a handle end 104, and a tip end 106. The tip end 106 is normally used for contacting an instrument.

Multiple grip members may be disposed on the ergonomic drumstick 100. For example, a user may use the tip end 106 as a handle to play, for example, a xylophone. Depending on the selected composition of the grip member 108, the user may utilize grip member 108 itself as a mallet head to contact, for example, a xylophone. In such an embodiment, the user may fit the tip end 106 with a second grip member 116, as illustrated in FIG. 1. Second grip member 116 is typically smaller than grip member 108. Second grip member 116 may also facilitate the use of the handle end as a mallet head, thereby providing the musician with the same advantageous, ergonomic grip when the drumstick is reversed in the user's hand.

Figure 2:
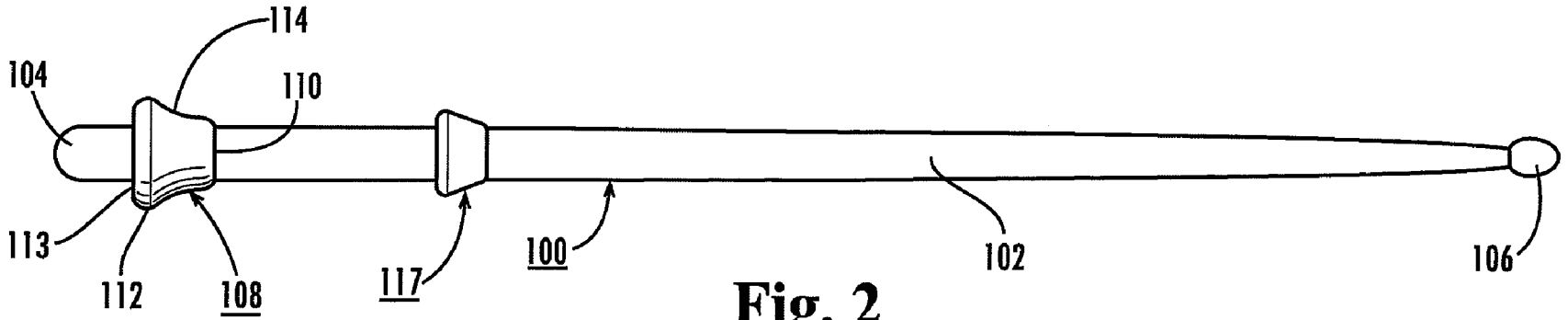
FIG. 2 illustrates another embodiment of an ergonomic drumstick.

FIG. 2 illustrates an alternate embodiment of the ergonomic drumstick 100. In this embodiment, a second grip member 117 is disposed on shaft member 102 so that the musician can effectively shorten the drumstick. This may be advantageous for younger musicians or when the musician needs a different effect which is achieved using a shorter drumstick.

Figure 3:
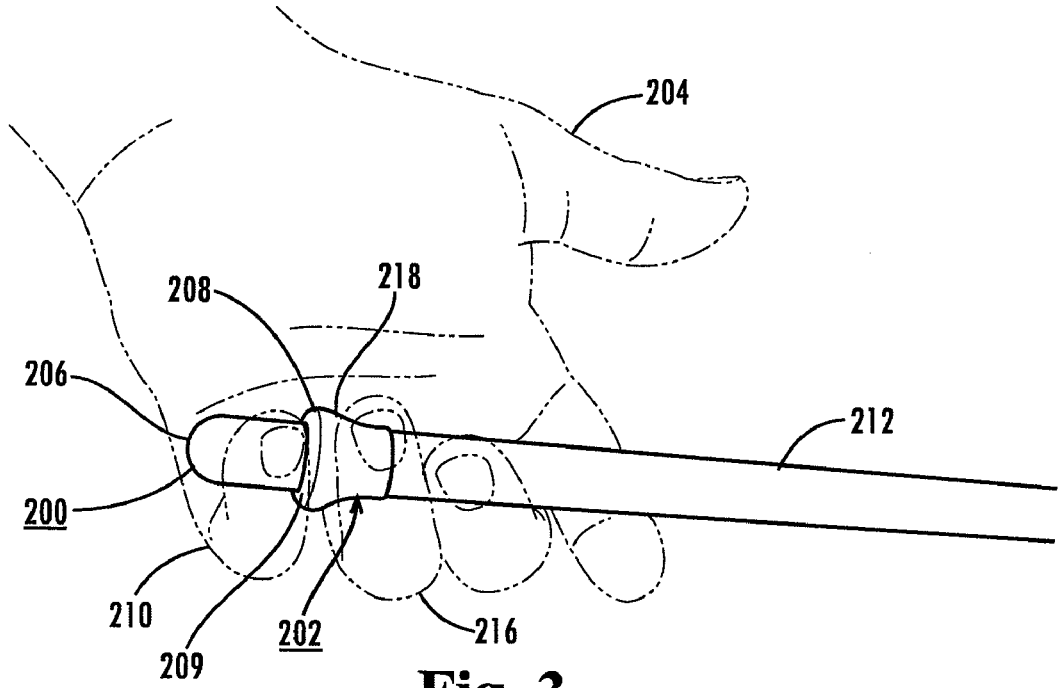
FIG. 3 illustrates a hand gripping another embodiment of an ergonomic drumstick.

FIG. 3 illustrates an alternative embodiment of an ergonomic drumstick 200. In this embodiment, a hand 204 grips the ergonomic drumstick 200. The hand 204 could be either a left hand or a right hand, unless the consumer specially adjusted the drumstick for a particular hand. The distance between the handle end 206 and the apex portion 208 is wider than the width of a first finger 210. Depending on the position of the grip member 202 on the shaft member 212, the distance between the handle end 206 and the apex portion 208 may accommodate a plurality of the user's fingers on the ergonomic drumstick 200.

As shown in FIG. 3, the first finger 210 engages ergonomically with the back end 209 of the apex portion 208 of the grip member 202. A second finger 216 rests on the load face portion 218. Thus, the hand 204 retains the ergonomic drumstick 200 with the grip member comfortably received between the fingers. The apex portion 208 blocks against the first finger 210 to restrict undesired movement of the ergonomic drumstick 200 toward the handle end 206. The slope of the load face portion 218 will also comfortably accommodate any of the fingers of the hand 204. For example, while FIG. 3 illustrates the drumstick retained between the little finger and the ring finger, the drumstick may also be held between the ring finger and the middle finger, and so on. The design is meant to be universal in this regard so that musicians, depending on their style of play, the music being played, or the requirements of the particular instrument, can comfortably and ergonomically achieve a comfortable and effective grip. The grip member 202 may consist of a softer material than the shaft member 212, which would also assist a comfortable grip.

Figure 4:
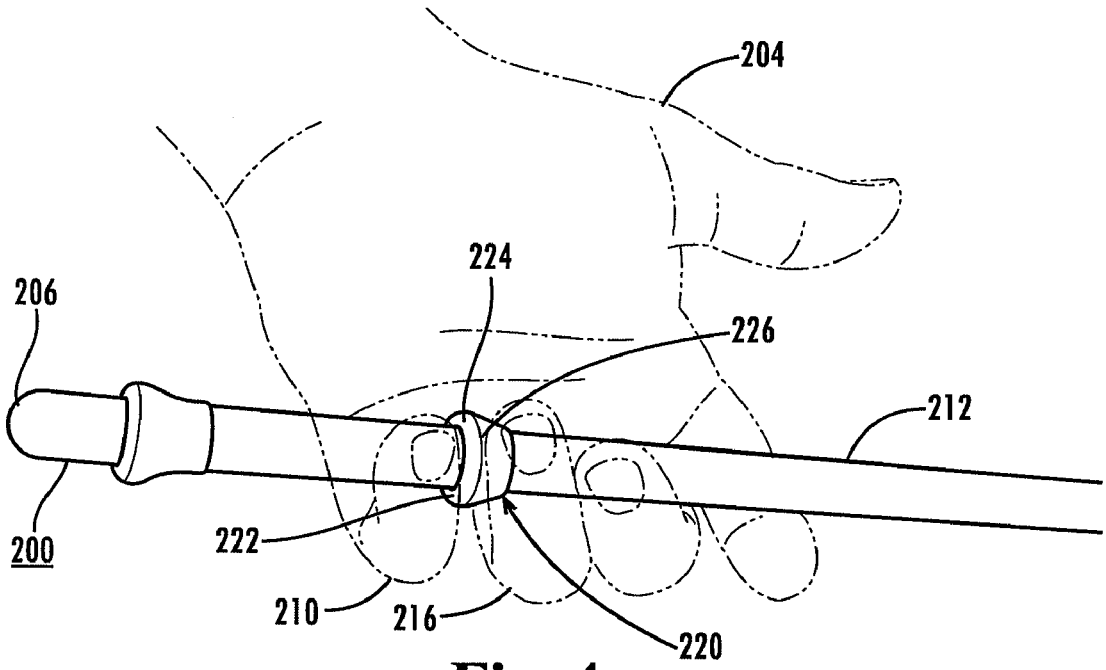
FIG. 4 illustrates a hand gripping an alternate embodiment of an ergonomic drumstick.

FIG. 4 illustrates a hand gripping an ergonomic drumstick similar to that shown in FIG. 2. An additional grip member 220 is disposed between grip member 202 and the tip end (not shown). The grip of the user is essentially the same as shown in FIG. 3 with the first or little finger 210 disposed against the back end 222 of the apex 224. The load face 226 rests between the first finger 210 and the second or ring finger 216, thereby resulting in an ergonomic fit between the fingers and the drumstick.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

What is claimed is:

1. A drumstick comprising:

a shaft member with a gripping end and a beater end; and a grip member including:

a load face portion being curvilinear with a concave taper;

an apex portion; and a bore;

wherein the grip member bore is positioned on the shaft member near the distal part of the gripping end of the shaft member, and the concave taper is oriented toward the beater end of the shaft, providing a grip for a user to retain the drumstick between the little finger and the ring finger, between the ring finger and the middle finger, or between the middle finger and the index finger.

2. The drumstick of claim 1, wherein the load face portion of the grip member is shaped such that it ergonomically engages a finger of the user.

3. The drumstick of claim 1, wherein the apex portion has a back end, the back end having a surface which is flat and substantially perpendicular to the bore.

4. The drumstick of claim 1, wherein the bore is cylindrical and has a diameter which is smaller than a diameter of the shaft member.

5. The drumstick of claim 1, further comprising a second grip member.

6. The drumstick of claim 5, wherein the second grip member is disposed on the shaft member near the distal part of the beater end of the shaft member and is smaller than the grip member.

7. A drumstick comprising:

a shaft member with a gripping end and a beater end; and a grip member including:

a bore;

a load face portion being curvilinear with a concave taper;

an apex portion having a back end, the back end having a surface which is flat and substantially perpendicular to the bore;

wherein the grip member bore is positioned on the shaft member near the distal part of the gripping end of the shaft member, and the concave taper is oriented toward the beater end of the shaft, providing a grip for a user to retain the drumstick between the little finger and the ring finger, between the ring finger and the middle finger, or between the middle finger and the index finger.

8. The drumstick of claim 7, wherein the load face portion is conical and tapered relative to the shaft member at an angle of between 30 and 60 degrees.

9. The drumstick of claim 7, further comprising a second grip member.

10. The drumstick of claim 9, wherein the second grip member is disposed on the shaft member near the distal part of the beater end of the shaft member and is smaller than the grip member.

11. The drumstick of claim 7, wherein the load face portion of the grip member is shaped such that it ergonomically engages a finger of the user.

12. The drumstick of claim 7, wherein the bore is cylindrical and has a diameter which is smaller than a diameter of the shaft member.

* * * * *